US006038709A

United States Patent [19]

Kent

[11] Patent Number: 6,038,709

[45] Date of Patent: Mar. 21, 2000

[54] TOILET PLUNGER HOLDER AND COVER

[76] Inventor: Dorothy M. Kent, 1401 Ashley Rd., Hoffman Estates, Ill. 60195

[21] Appl. No.: 09/225,456

[22] Filed: Jan. 6, 1999

[51] Int. Cl.[7] ..... A45C 11/00

[52] U.S. Cl. ..... 4/255.05; 4/255.11; D6/551; 206/15.3; 15/160; 15/184

[58] Field of Search ..... 4/255.01, 255.04–255.12, 4/661; D6/524, 551; 15/159.1, 160, 184; 206/15.3, 349

[56] References Cited

U.S. PATENT DOCUMENTS

| | | | |
|---|---|---|---|
| D. 214,454 | 6/1969 | Warnberg | D6/551 |
| D. 368,820 | 4/1996 | Sander | D6/551 |
| D. 383,935 | 9/1997 | Zawalsky | D6/524 |
| D. 404,951 | 2/1999 | Zawalsky | D6/551 |
| 2,448,603 | 9/1948 | Kevin et al. | 206/15.3 |
| 4,135,251 | 1/1979 | Uhrman | 4/309 |
| 4,211,750 | 7/1980 | Gillespie | 422/123 |
| 4,776,456 | 10/1988 | Lewis | 206/15.3 |
| 5,040,679 | 8/1991 | Rehmann | 206/457 |
| 5,456,356 | 10/1995 | Kurzawa | 206/349 |
| 5,836,322 | 11/1998 | Borger et al. | 134/42 |
| 5,927,492 | 7/1999 | Moore | 206/349 |

*Primary Examiner*—Charles R. Eloshway
*Attorney, Agent, or Firm*—Dillis V. Allen, Esq.

[57] ABSTRACT

A toilet plunger holder and cover including a cylindrical base coextensive in height with the plunger elastomeric head and a cover for the base with a narrow tubular portion that covers and is coextensive in length with the plunger handle. Partitions and a deodorizing substance holder are molded integrally with the base bottom wall, and these partitions hold the plunger head above the bottom wall for drying. The entire holder receives a rigid decorative overlay that is connected to the holder cover so the overlay and cover are removed as a unit from the base. In one embodiment, the holder cover is made of a ceramic material with an elastomeric bumper that prevents damage to the ceramic.

9 Claims, 3 Drawing Sheets

(EMBODIMENT #1)

(EMBODIMENT #1)

(EMBODIMENT #1)

(EMBODIMENT #1)

(EMBODIMENT #1)

(EMBODIMENT #2)

(EMBODIMENT #3)

(EMBODIMENT #4)

TOILET PLUNGER HOLDER AND COVER

BACKGROUND OF THE INVENTION

There have in the past been provided several different types of covers for brushes and toilet plungers usable in the bathroom area. One of these is described in the Warner, et al., U.S. Pat. No. 2,630,912, which discloses a container 10 for a brush 20 that has a handle portion that appears to be locked inside the cover 16. A deodorizing bottle 20 is provided in the bottom of the cylindrical container 12. The Warner, et al. holder is not designed to hold a toilet plunger and does not have a narrow cylindrical cover for just its handle.

The Wilk Tool Assembly, U.S. Pat. No. 5,114,006, discloses a cylindrical cover for a tool such as a toilet plunger. There are some 43 different figures in the Wilk patent, and Mr. Wilk suggests a variety of different shapes for the tool housing and closure elements. None, however, appears to have a shape that conforms to the shape of the plunger itself, and thus, is unnecessarily costly and difficult to operate.

There is also a brush cover that is currently being marketed and apparently not the subject of any patent, at least not a United States Patent. Applicant would be happy to provide the Patent Office with photographs of this brush cover if requested to do to. This cover assembly includes a long, lower cylindrical housing having a relatively short removable top cover. The top cover has a central upward projection that fits closely around the brush handle except that it does not extend all the way downwardly near the tool housing.

Also, brush and tool covers are shown in the following patents: the Bechler, U.S. Pat. No. 162,605; the Quinlan, U.S. Pat. No. 3,130,421; the Tash, U.S. Pat. No. 4,745,641, and the Isakson, Des. U.S. Pat. No. 306,756.

None of the above covers corresponds closely to the shape of a standard toilet plunger, and thus, in manufacture would be unnecessarily costly, and because of their configuration, it is difficult to expose the toilet plunger or brush for removal and replacement in the unit.

It is a primary object of the present invention to ameliorate the problems noted above in toilet plunger holders and covers.

SUMMARY OF THE PRESENT INVENTION

In accordance with the present invention, a toilet plunger holder and cover is provided that includes a cylindrical base coextensive in height with the plunger elastomeric head and a cover for the base with a narrow tubular portion that covers and is coextensive in length with the plunger handle. This design firstly dramatically reduces the cost of the holder and cover over prior units, but more importantly, it is far easier to expose the plunger for removal and replacement by grasping the narrow handle cover and raising it to expose the entire handle of the plunger.

Partitions and a vented deodorizing substance are molded integrally with the base bottom wall to provide an extremely low cost unit, and these partitions hold the plunger head spaced above the bottom wall to enhance drying of the plunger elastomeric head after use. The entire holder receives a rigid decorative overlay that is connected to the holder cover so the overlay and cover are removed as a unit from the base. In one embodiment, the holder cover is ceramic, and an elastomeric bumper is provided to prevent damage to the ceramic material.

In another embodiment, the ceramic cover has an integral snap-action connection to the narrow tubular cover handle which is constructed of a different material.

A primary object of the present invention is to provide a toilet plunger holder and cover that is aesthetically pleasing and can be displayed in the bathroom area without offending anyone in the household or their guests.

The decorative overlays can be exchanged without replacing the basic holder and cover. The overlay can be made from a variety of materials including decorative plastic with printed artwork, as well as decorative brass.

Other objects and advantages of the present invention will appear more clearly from the following detailed description.

DETAILED DESCRIPTION OF THE PREFERRED EMBODIMENTS

Figure 1:
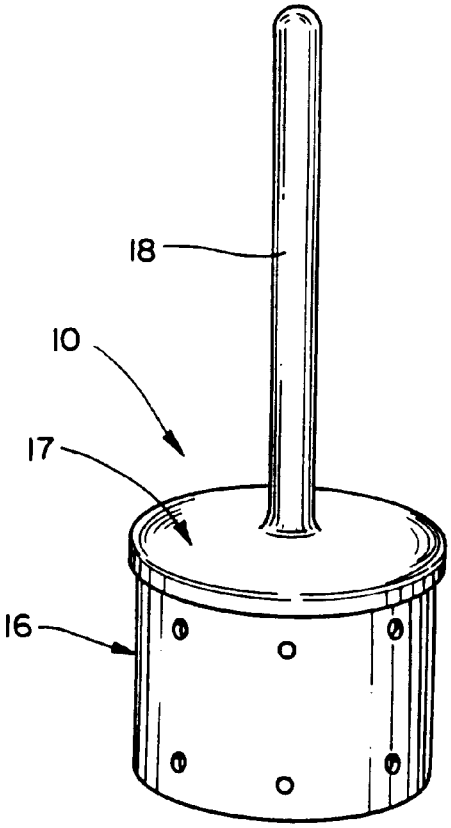
FIG. 1 is a perspective view of a toilet plunger holder and cover according to one embodiment of the present invention.
Figure 2:
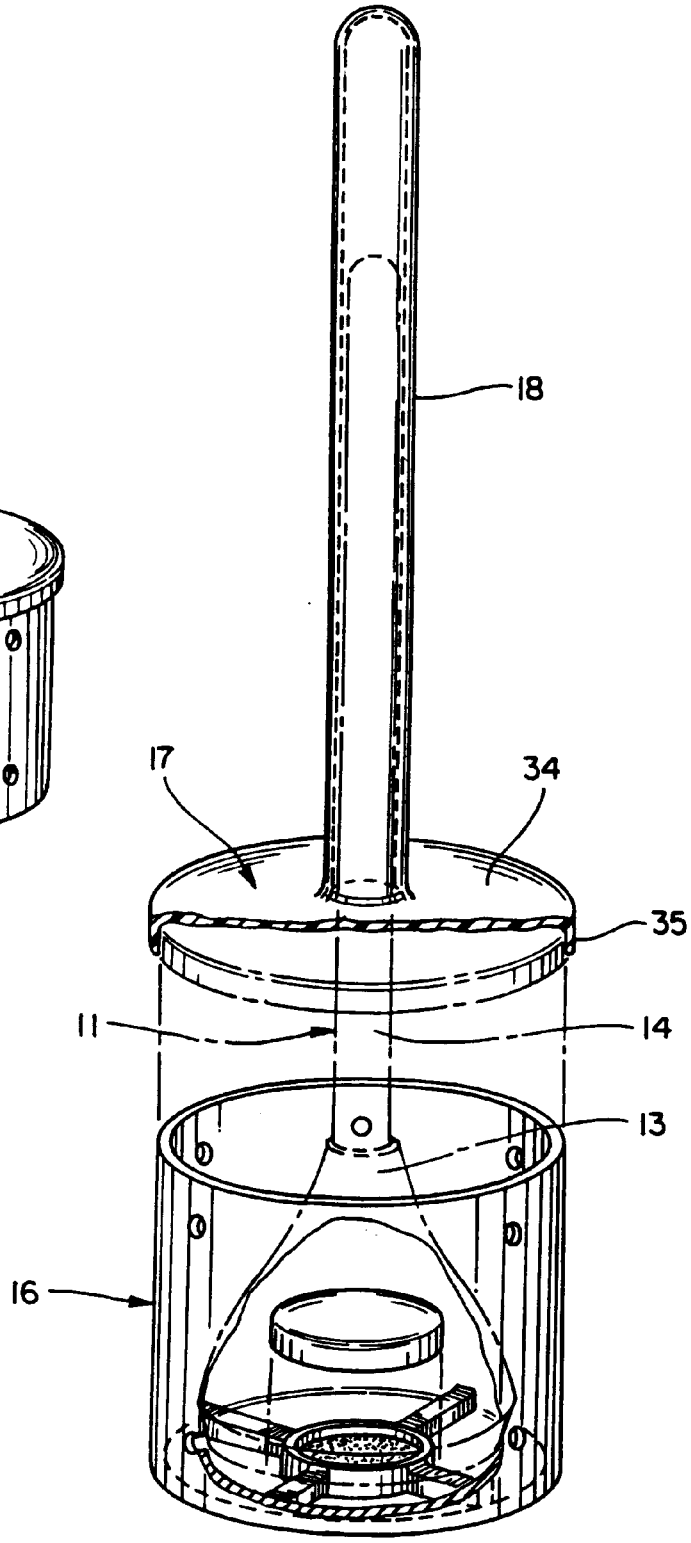
FIG. 2 is an enlarged exploded view of the toilet plunger holder and cover illustrated in FIG. 1, showing the toilet plunger inside the holder and cover.

Referring to the drawings and particularly FIGS. 1 to 5, a toilet plunger holder and cover assembly 10 is illustrated for covering and deodorizing and concealing a standard toilet plunger 11. The toilet plunger 11 includes a lower bell-shaped elastomeric suction element 13 and an elongated narrow handle 14. One of the important features of the present invention is the relationship between the size of the holder and cover 10 in relation to the size of the elastomeric plunger head 13 and the narrow handle 14.

The holder and cover assembly 10 includes a molded plastic base 16 and a removable cover 17 that has a narrow tubular portion 18 that fits closely around the plunger handle 14 and is substantially coextensive in length with the handle 14. Furthermore, the base 16 has a height that is substantially coextensive in height with the elastomeric plunger head 13. These relationships not only reduce the cost of manufacture for the assembly 10, but more importantly, these relationships improve the ease of exposing the plunger 14. That is, any portion of the tubular portion 18 may be grasped in removing the cover 17 from the base 16. This removal exposes almost the entire plunger 11 to the user who may grasp any portion of the handle 14 and even the upper portion of the elastomeric head 13 to remove and replace the plunger in the proper position in relation to the base 16.

The base 16 includes a circular flat bottom wall 20 and an upstanding cylindrical side wall 21. A deodorizing compartment 22 in the bottom of the base 16 includes an integrally molded annular wall 24 with a removable lid 25 and a plurality of apertures 26 therein, all enclosing a deodorizing substance 27.

Figure 3:
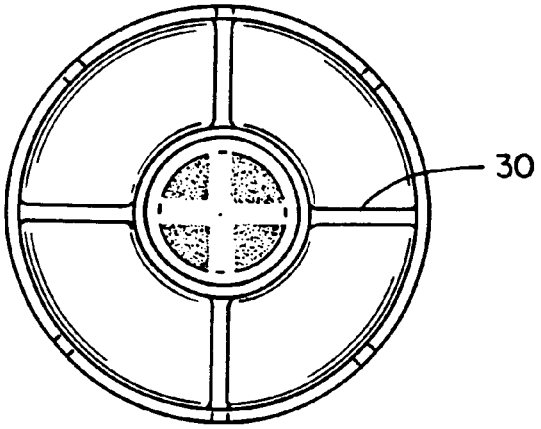
FIG. 3 is a top view of the base of the holder and cover illustrated in FIGS. 1 and 2.
Figure 4:
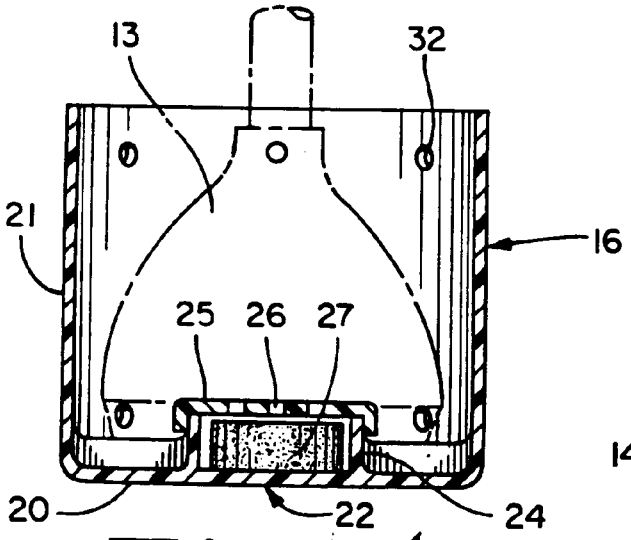
FIG. 4 is a longitudinal section through the holder and cover base illustrated in FIGS. 1 to 3.
Figure 5:
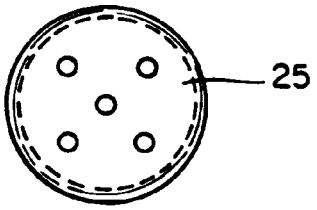
FIG. 5 is a top view of the deodorizer lid illustrated in FIGS. 3 and 4.

As seen in FIGS. 3 and 4, four radial partitions 30 are integrally molded with the bottom wall 20, the side wall 21, and the annular wall 24, and serve to space the elastomeric plunger head 13 upwardly from the bottom wall 20 for improved drying of the inside of the plunger head 13, particularly the inside of the plunger head, which would otherwise be sealed to the bottom wall 20.

The side wall 21 has a plurality of vents 32 therein.

The removable lid 17 includes a slightly crowned but generally flat lid portion 34 having a downwardly turned lip 35 that engages the upper outer surface of the base side wall 16. A narrow elongated tubular portion 18 is integrally formed with the lid portion 34 and both can be manufactured in a one-piece injection molding operation.

Figure 6:
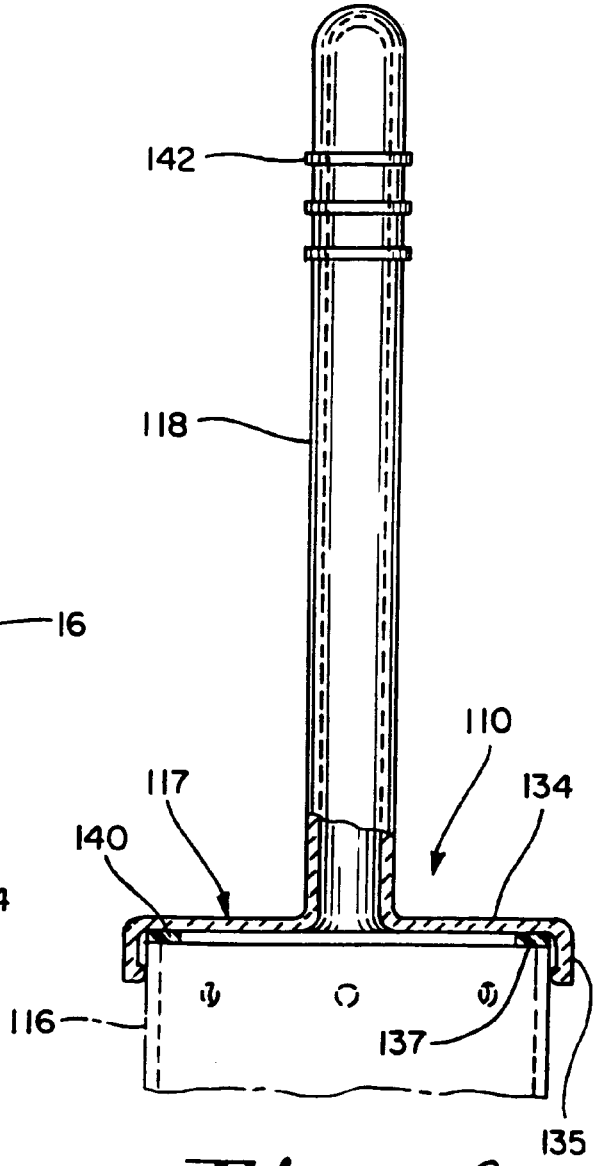
FIG. 6 is a fragmented section of a toilet plunger holder and cover according to another embodiment of the present invention.

In FIG. 6, a second embodiment of the present invention is illustrated and designated 110 and is seen to include a base 116 similar to base 16 and a cover 117 that is similar to shape to cover 17 except that it is constructed of a ceramic material, and as seen, includes a generally flat circular disc portion 134 with a downwardly turned lip 135. A narrow elongated handle cover portion 118 is formed integrally with the lid 134, and thus, is also constructed of a ceramic material. A flat annular elastomeric rubber bumper 137 is fixed to the lower wall of the flat disc portion 34 and engages upper end 140 of the base wall 116 to protect the ceramic cover 117 from damage as it is removed and replaced on base 116. A plurality of integral rings 142 on handle portion 118 facilitate removal of the cover 117 because the user can get a better grip on the handle portion.

Figure 7:
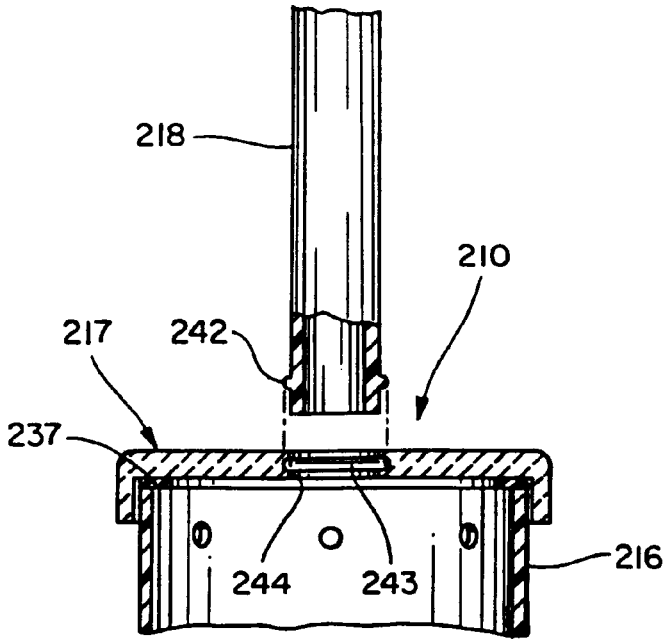
FIG. 7 is a fragmented exploded view of still another embodiment of the present toilet plunger holder and cover.

A modified embodiment is illustrated in FIG. 7, and this plunger holder and cover is designated 210, and includes a base 216, a lid 217, and a separate handle cover portion 218. In the FIG. 7 embodiment, the lid 217 is constructed of a ceramic material and it has a bumper 237 on the lower surface thereof that functions in the same manner as the bumper 137 in the FIG. 6 embodiment. In the FIG. 7 embodiment, however, the handle portion 218 is constructed of a non-ceramic material, such as an injection molding, to minimize the distortion effects from forming the lid and the handle in one piece, as in the FIG. 6 embodiment. The handle portion 218 has an integrally molded annular somewhat flexible projection 242 near its lower end that snap fits into an annular recess 243 integral in an aperture 244 in the lid 217 so that the handle portion 218 and the lid 217 can be locked together without any separate fasteners, although some bonding agent could be used at this joint, if necessary.

Figure 8:
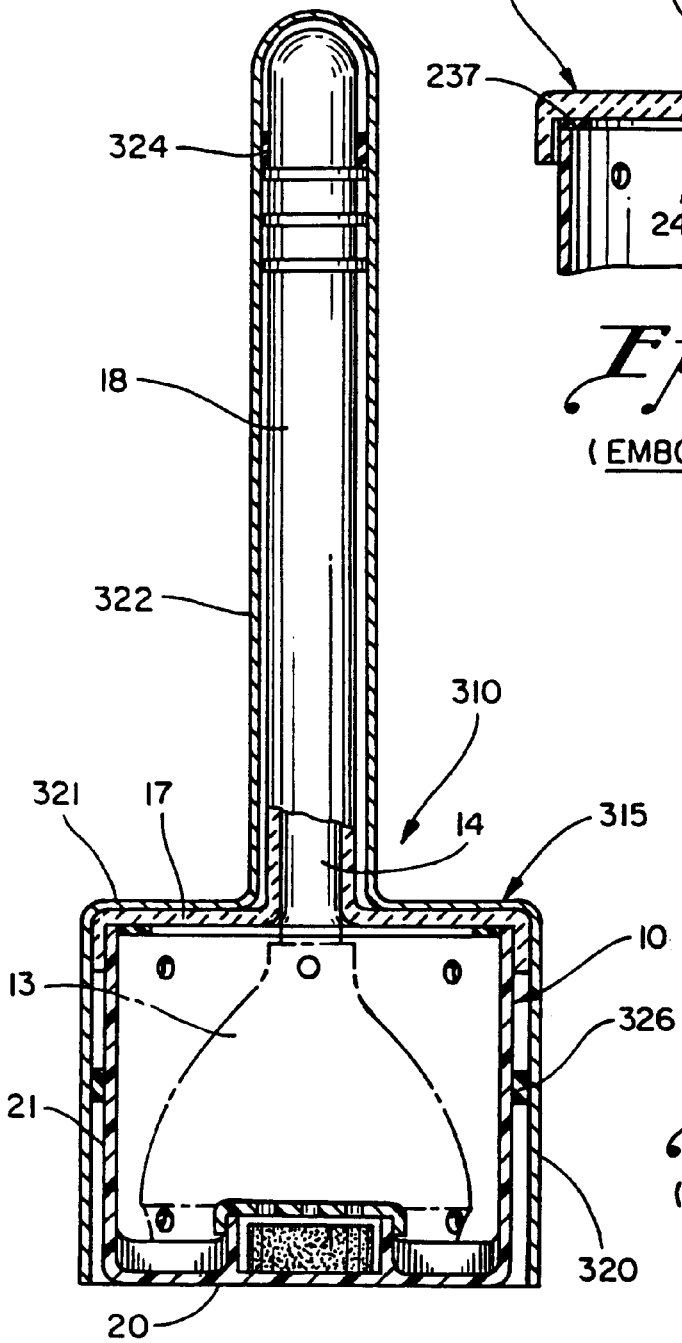
FIG. 8 is a partly fragmented longitudinal section of a toilet plunger holder and cover according to another embodiment of the present invention shown with a rigid decorative overlay, also in accordance with the present invention.

In FIG. 8, a further embodiment of the present invention is illustrated and the plunger and holder cover depicted therein is identified by reference numeral 310, and it is seen to include a holder and cover 10 similar to the one illustrated in FIGS. 1 to 5, enclosed by a rigid decorative second cover or overlay 315. The rigid overlay or cover 315 has several purposes. Firstly, it is primarily for decorative purposes and eliminates the need for decorations directly on the outer surfaces of the primary holder and cover 10. It also enables the user, because the overlay at 315 is removable from the holder and cover 10, to switch decorations without purchasing another primary cover 10, thereby significantly reducing overall cost. The decorative overlay 315 can be constructed of a variety of materials, such as plastic, paperboard, and decorative brass, as well. The overlay 315 can also carry on its outer surfaces seasonal artwork, such as those depicting various holiday scenes.

The overlay 315 is preferably constructed of one piece and includes a downwardly opening cylindrical portion 320, an integral flat circular disc portion 321, and an upwardly closed narrow cylindrical tubular portion 322, that is complementary to and conforms in shape with the tubular portion 18 of the primary holder and cover 10.

The decorative cover 315 is attached to the cover 17 by an elastomeric ring 324 that has an inner diameter slightly less than the outer diameter of the handle portion 18. The overlay 315 is installed on handle portion 18 with the ring 324 in position inside the tubular portion 322 so the handle 18 deforms the ring 324 radially outwardly, and thus frictionally holding the decorative tubular portion 322 to the handle portion 18.

A second elastomeric ring 326 is bonded to the inside of the lower decorative overlay wall 320, but this ring does not lock the decorative cover to the primary holder and cover wall 21, but merely loosely spaces one from the other, bearing in mind that the decorative cover 315, while it covers the base 16 completely, except for bottom wall 20, is attached to the cover 17 at its handle portion 18. Thus, in removing the cover 17, the user grasps the decorative tubular portion 322, which is rigid as well, and lifts upwardly, thereby simultaneously withdrawing decorative cover from the base 16 and the primary cover 17 from the base thereby exposing the plunger handle and plunger head 13 the easy withdrawal movement described above.

I claim:

1. A holder for a toilet plunger of the type having an elastomeric suction head and a long narrow projecting handle, comprising: a generally cylindrical base having a bottom wall and a generally cylindrical side wall extending upwardly from the bottom wall, means on the bottom wall for supporting the lower surface of the plunger elastomeric head, said cylindrical side wall extending upwardly to about the height of the elastomeric head, a removable cover for the base including a circular portion engageable with the base side wall and a narrow elongated tubular portion for enclosing the plunger handle, said tubular portion having an axial extent about the same as the plunger handle, whereby the holder configuration is optimized, and means integrally formed with the base bottom wall for holding a deodorizing substance including a cylindrical wall formed with the bottom wall, and a plurality of radial partitions extending from near the cylindrical wall generally radially outwardly for spacing the plunger elastomeric head above the bottom wall, said cylindrical wall extending upwardly above the ribs so the deodorizing substance is directed generally inside the elastomeric head.

2. A holder for a toilet plunger as defined in claim 1, wherein the cover circular portion is ceramic, and an elastomeric ring on the lower surface of the circular portion positioned to engage the base cylindrical wall to prevent damage to the ceramic cover circular portion.

3. A holder for a toilet plunger as defined in claim 2, wherein the cover tubular portion is a non-ceramic material, means integral with the cover tubular portion and the cover circular portion for connecting the two together without separate fasteners.

4. A holder for a toilet plunger as defined in claim 3, wherein said means integral with the cover tubular portion and the cover circular portion for connecting the two together without separate fasteners includes an integral ring on one portion and an integral recess on the other portion adapted to interfit one another.

5. A holder for a toilet plunger of the type having an elastomeric suction head and a long narrow projecting handle, comprising: a generally cylindrical base having a bottom wall and a generally cylindrical side wall extending upwardly from the bottom wall, said cylindrical side wall extending upwardly to about the height of the elastomeric head, a removable cover for the base including a circular portion engageable with the base side wall and a narrow elongated tubular portion for enclosing the plunger handle, said tubular portion having an axial extent about the same as the plunger handle, whereby the holder configuration is optimized, including means on the base bottom wall for spacing the plunger elastomeric head above the bottom wall to promote drying thereof, and means integrally formed with the base bottom wall for holding a deodorizing substance, said means for spacing the plunger elastomeric head above the bottom wall including a plurality of radial partitions integrally formed with the bottom wall, said means for holding a deodorizing substance including a cylindrical wall integrally formed with the bottom wall, said radial partitions extending outwardly from the cylindrical wall.

6. A holder for a toilet plunger of the type having an elastomeric suction head and a long narrow projecting handle, comprising: a generally cylindrical base having a bottom wall and a generally cylindrical side wall extending upwardly from the bottom wall, said cylindrical side wall extending upwardly to about the height of the elastomeric head, a removable cover for the base including a circular portion engageable with the base side wall and a narrow elongated tubular portion for enclosing the plunger handle, said tubular portion having an axial extent about the same as the plunger handle, whereby the holder configuration is optimized, the cover circular portion being ceramic, and an elastomeric ring on the lower surface of the circular portion positioned to engage the base cylindrical wall to prevent damage to the ceramic cover circular portion, the cover tubular portion being a non-ceramic material, and means integral with the cover tubular portion and the cover circular portion for connecting the two together without separate fasteners.

7. A holder for a toilet plunger as defined in claim 6, wherein said means integral with the cover tubular portion and the cover circular portion for connecting the two together without separate fasteners includes an integral ring on one portion and an integral recess on the other portion adapted to interfit one another.

8. A holder for a toilet plunger of the type having an elastomeric suction head and a long narrow projecting handle, comprising: a generally cylindrical base having a bottom wall and a generally cylindrical side wall extending upwardly from the bottom wall, said cylindrical side wall extending upwardly to about the height of the elastomeric head, a removable cover for the base including a circular portion engageable with the base side wall and a narrow elongated tubular portion for enclosing the plunger handle, said tubular portion having an axial extent about the same as the plunger handle, whereby the holder configuration is optimized, including a rigid decorative overlay for the base and the cover including a downwardly opening cylindrical part surrounding the base and circular portion and a narrow tubular part extending upwardly for the cylindrical portion, and means connecting the rigid decorative overlay to the cover tubular portion and cylindrical portion so the decorative overlay and the cover can be removed as a unit from the base to expose the plunger for removal and replacement.

9. A holder for a toilet plunger as defined in claim 8, wherein said means connecting the rigid decorative overlay to the cover tubular portion and flat and cylindrical portion so the decorative overlay and the cover can be removed as a unit from the base to expose the plunger for removal and replacement includes an elastomeric ring between the inside of the tubular part and the outside of the tubular portion.

* * * * *